US006669013B1

(12) United States Patent
Villanueva

(10) Patent No.: US 6,669,013 B1
(45) Date of Patent: Dec. 30, 2003

(54) DISPOSABLE BABY BOTTLE

(76) Inventor: Amado Villanueva, 7500 Callaghan Rd. #204, San Antonio, TX (US) 78229

( * ) Notice: Subject to any disclaimer, the term of this patent is extended or adjusted under 35 U.S.C. 154(b) by 0 days.

(21) Appl. No.: 09/607,868

(22) Filed: Jun. 30, 2000

Related U.S. Application Data

(60) Provisional application No. 60/141,607, filed on Jun. 30, 1999.

(51) Int. Cl.[7] ..... B65D 25/08

(52) U.S. Cl. ..... 206/219; 215/DIG. 8

(58) Field of Search ..... 206/219; 215/11.1, 215/11.3, 11.6, DIG. 8, 208; 426/117

(56) References Cited

U.S. PATENT DOCUMENTS

| | | | | | |
|---|---|---|---|---|---|
| 2,786,769 | A | | 3/1957 | Greenspan | |
| 2,793,776 | A | | 5/1957 | Lipari | |
| 2,876,113 | A | | 3/1959 | Barton | |
| 2,885,104 | A | | 5/1959 | Greenspan | |
| 2,931,731 | A | | 4/1960 | Pohjola | |
| 2,960,088 | A | * | 11/1960 | Witz | 215/11.4 |
| 3,143,429 | A | | 8/1964 | Swanson et al. | |
| 3,650,270 | A | * | 3/1972 | Frazier | 215/11.5 |
| 4,519,499 | A | * | 5/1985 | Stone et al. | 206/219 |
| 4,629,080 | A | * | 12/1986 | Carveth | 215/11.1 |
| 4,678,092 | A | | 7/1987 | Rane | |
| 4,895,264 | A | * | 1/1990 | Phlaphongphanich | 215/11.1 |
| 4,952,068 | A | * | 8/1990 | Flint | 366/337 |
| 5,209,372 | A | | 5/1993 | Norwood | |
| 5,287,961 | A | * | 2/1994 | Herran | 206/219 |
| 5,316,160 | A | * | 5/1994 | Cautereels | 215/11.1 |
| 5,492,219 | A | * | 2/1996 | Stupar | 206/219 |
| 5,588,548 | A | | 12/1996 | Brankley | |
| 5,928,213 | A | * | 7/1999 | Barney et al. | 604/410 |
| 6,036,004 | A | * | 3/2000 | Bowen | 206/219 |
| 6,113,257 | A | * | 9/2000 | Sharon et al. | 366/130 |

* cited by examiner

*Primary Examiner*—Shian Luong
(74) *Attorney, Agent, or Firm*—David O. Lucas

(57) ABSTRACT

An infant beverage dispenser carries a beverage powder and a liquid in separate compartments until needed. The compartments are contained in a flexible bag and are separated by each other by a seam. The seam is rupturable due to manual squeezing of the compartment containing the liquid. Once ruptured, the liquid mixes with powder to create the beverage. A nipple is attached to the outlet of the bag for allowing the beverage to be dispensed.

12 Claims, 3 Drawing Sheets

DISPOSABLE BABY BOTTLE

CROSS-REFERENCE TO RELATED APPLICATION

This invention is based on provisional application No. 60/141,607 filed Jun. 30, 1999.

TECHNICAL FIELD

This invention relates in general to containers for dispensing a beverage, and in particular to a container that holds a powder and a liquid in separate compartments that are sealed from each other until the beverage is to be dispensed.

BACKGROUND ART

Disposable baby bottles are marketed wherein the user prepares the beverage at home, then fills the bottle and dispenses it shortly after. While away from home, however this becomes more difficult. If the beverage, such as in infant formula, is placed in the bottle at home, it may spoil prior to use. While powdered infant formula is available that can be mixed water, this too can be a problem. The parent must either carry water or be able to locate purified water wherever the parent may be.

U.S. Pat. No. 2,885,104 shows a bottle with a disposable cartridge. The cartridge has two compartments, one containing a powder and the other a liquid. These compartments are separated by a sealing juncture that is penetrated by pulling on a tab. When pulled, the tab breaks the sealing juncture, allowing the liquid to mix with the powder for dispensing.

SUMMARY OF INVENTION

In this invention, the dispenser has a flexible bag with an outlet and two compartments. One compartment is adapted to contain beverage powder while the other is adapted to contain a liquid. A seam separates the two compartments. The seam is rupturable due to manual squeezing of the compartment containing the liquid. This allows the liquid to flow into the other compartment and mix with the powder to create a beverage. A mouthpiece or nipple is attached to the bottle for allowing the beverage to be dispensed.

DESCRIPTION OF THE PREFERRED EMBODIMENT

Figure 1:
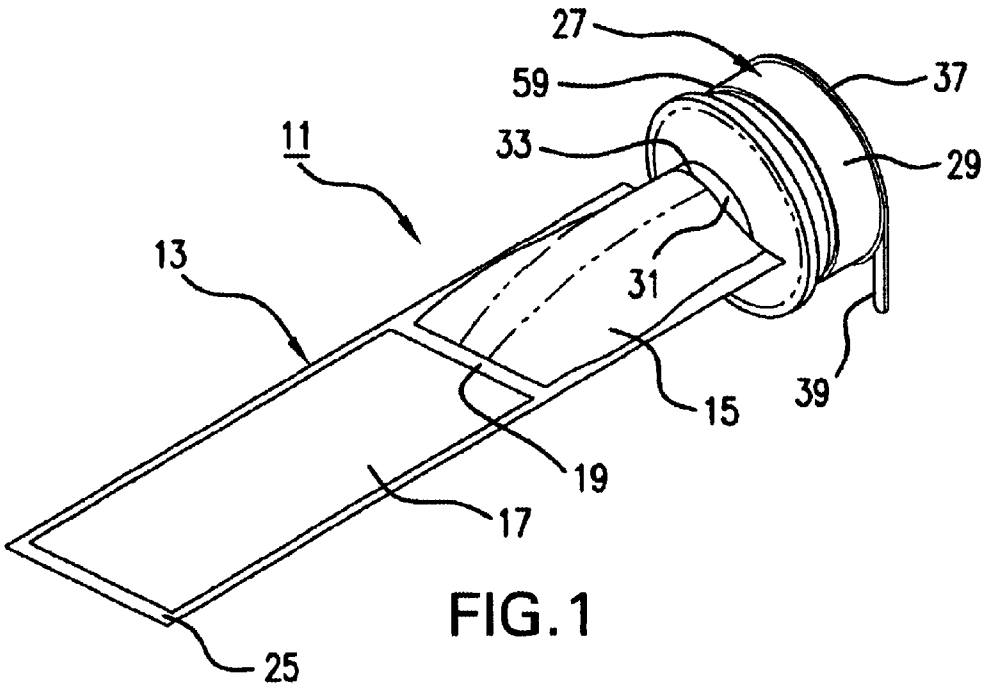
FIG. 1 is a perspective view of a beverage dispenser in accordance with this invention, shown filled with liquid and powder in separate compartments.

Referring to FIG. 1, dispenser 11 includes a bag 13 that may be of plastic or other flexible impermeable material.

Bag 13 is an elongated rectangular member that is substantially flat prior to filling. Bag 13 has a powder compartment 15, which is shown in this embodiment to be on the upper end, and a water compartment 17. Compartments 15, 17 could be reversed from each other. A transverse seam 19 extends between compartments 15, 17, sealing them from each other initially. Seam 19 is located about midway along the length of dispenser 11, making compartments 15, 17 about the same size as each other, however this need not be so.

Figure 2:
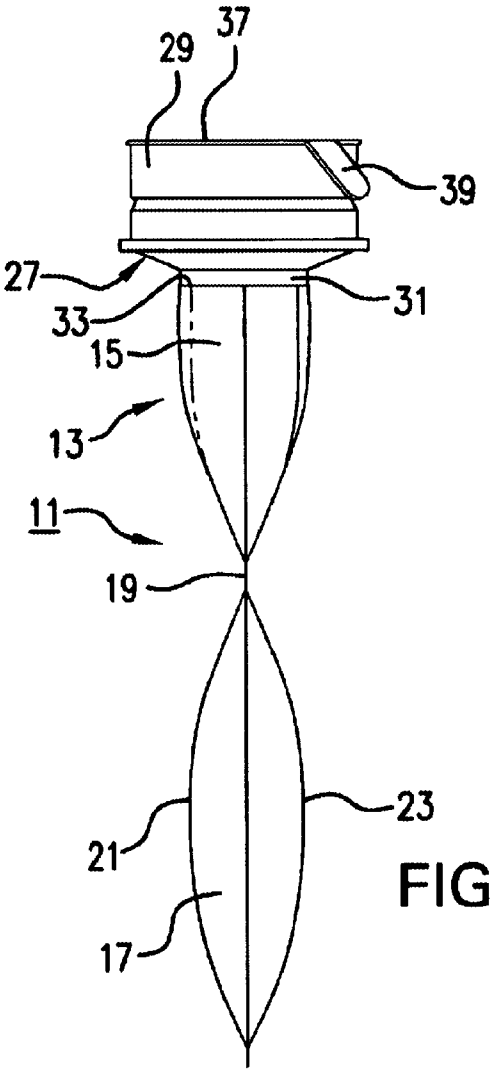
FIG. 2 is a side elevational view of the beverage dispenser of FIG. 1.

Referring to FIG. 2, in this embodiment, bag 13 has a pair of sidewalls 21, 23. Seam 19 is formed by contacting interior portions of sidewalls 21, 23 with each other, then bonding sidewalls 21, 23 together at the contact line. The bonding may be by heat sealing or other known techniques. Furthermore, a perimeter seal 25 extends around the perimeter of bag 13 as shown in FIG. 1. While bag 13 is shown to be two flat pieces bonded together around perimeter seal 25, it could also be formed as a tubular member, in which case perimeter seal 25 would not be necessary on the sides.

Figure 3:
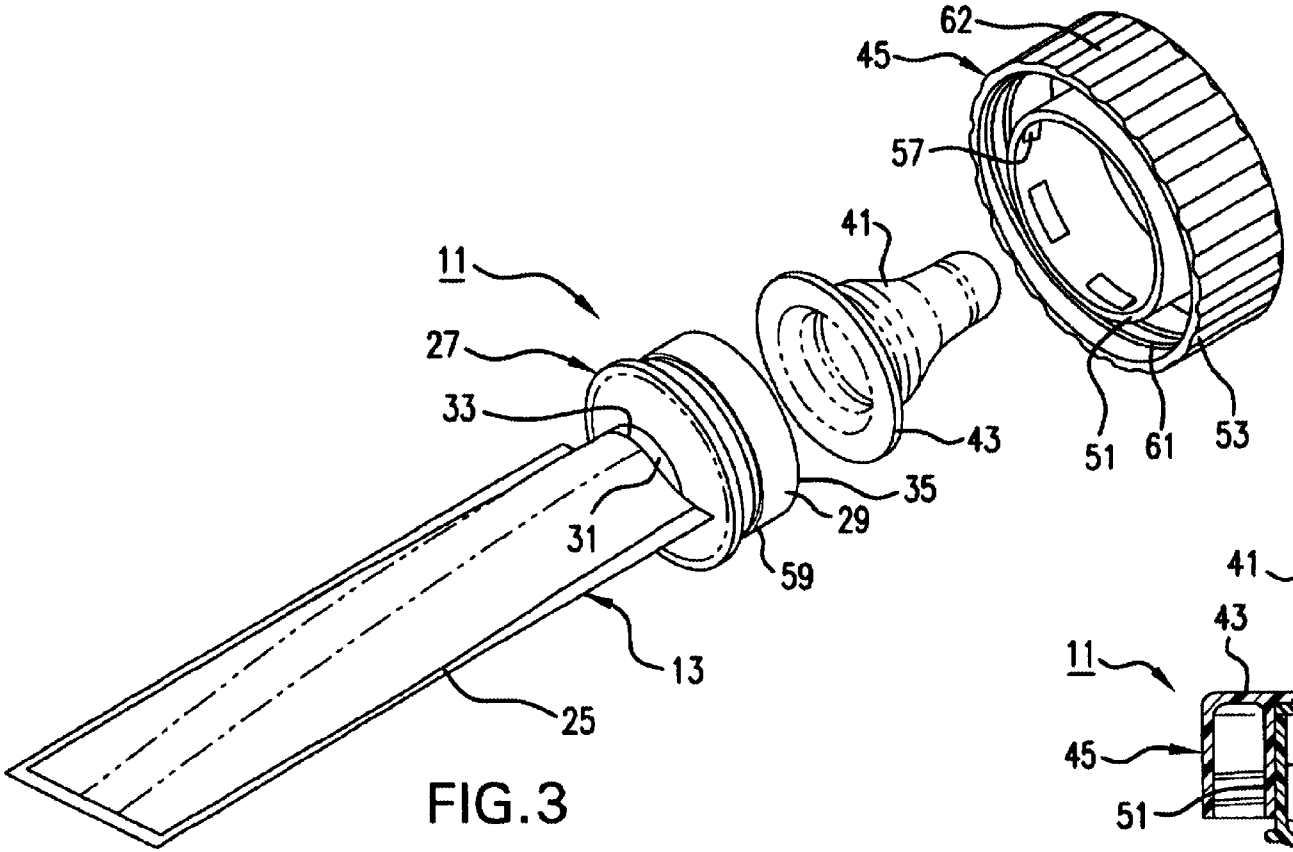
FIG. 3 is a perspective view of the dispenser of FIG. 1, shown after the powder and liquid have been mixed, and shown along with a nipple and a retainer ring in exploded form.
Figure 5:
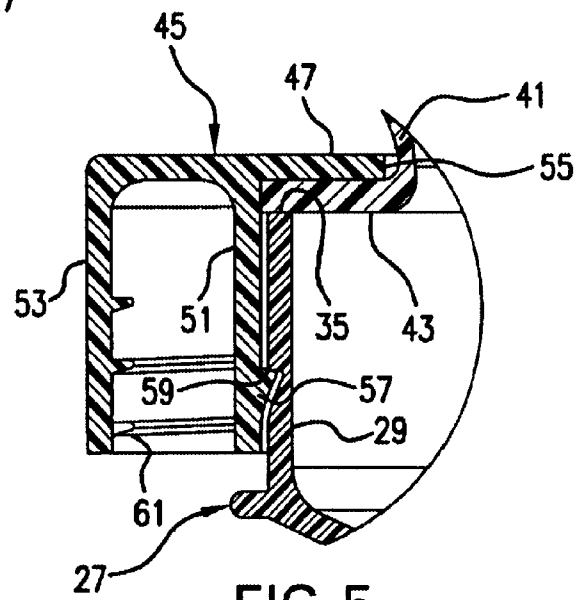
FIG. 5 is an enlarged sectional view of a portion of dispenser as shown in FIG. 4.
Figure 6:
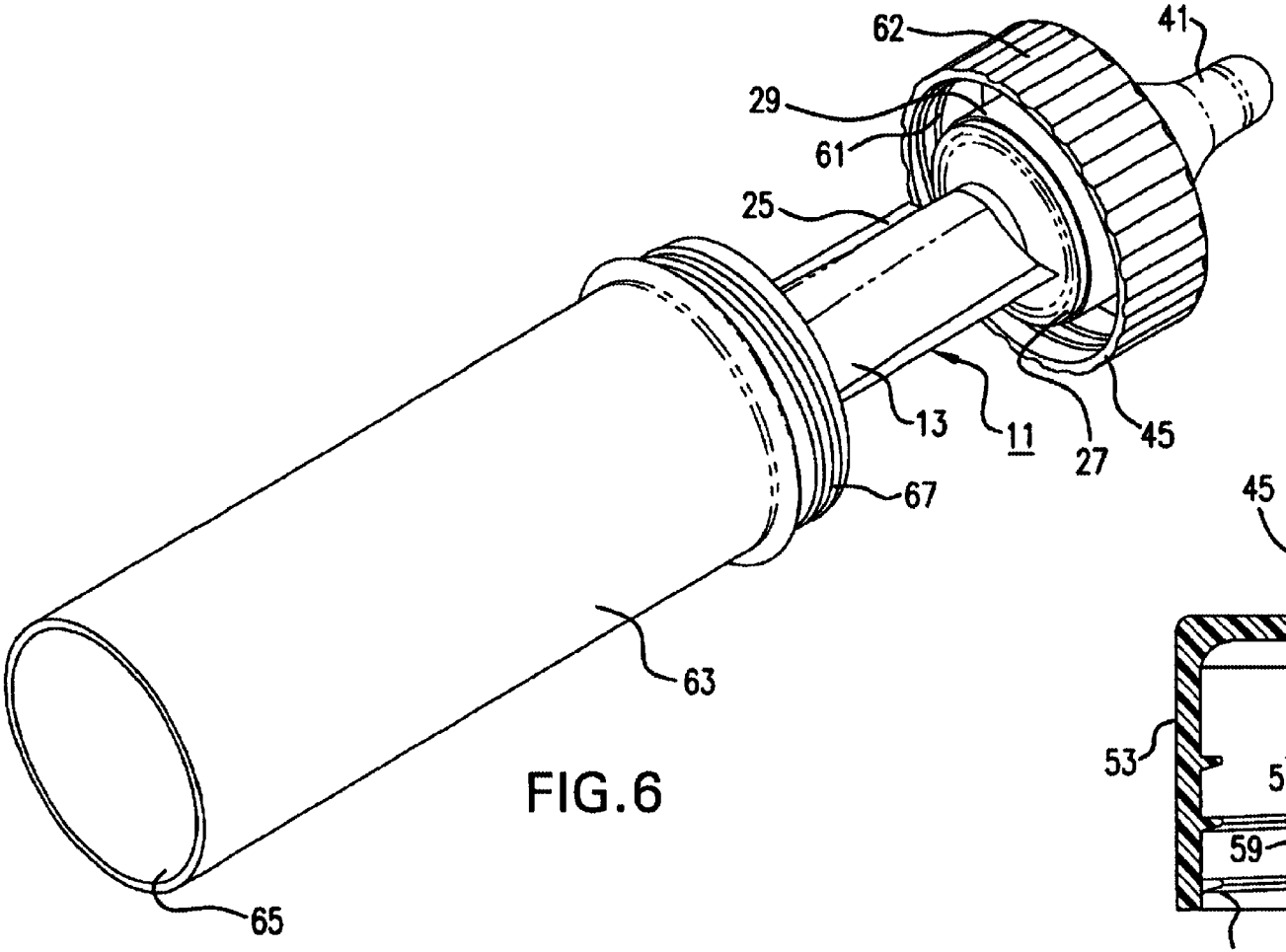
FIG. 6 is a perspective view of the dispenser as shown in FIG. 3 being positioned within a housing.

Bag 13 is secured to a nipple base 27 on its upper end. The terms "upper" and "lower" are used for convenience herein, as dispenser 11 can be oriented in any manner. Nipple base 27 has a cylindrical base wall 29 that is concentric with the longitudinal axis of nipple base 27 and bag 13. A neck 31 joins base wall 29. Neck 31 has a considerably smaller outer diameter than the outer diameter of base wall 29. Bag 13 has a mouth 33 that seals over neck 31. As shown in FIG. 5, base wall 29 has a rim 35 on its upper end. Initially, a sealing disk 37 will be adhesively secured to rim 35 to prevent any leakage from bag 13 and to discourage tampering. Sealing disk 37 has a pull tab 39 that enables disk 37 to be readily pulled from rim 35 when dispenser 11 is to be used. FIG. 3 shows sealing disk 37 removed.

Referring still to FIG. 3, a mouthpiece or nipple 41 of conventional design is adapted be coupled to nipple base 27, which serves as an outlet for the contents of bag 13. Nipple 41 has a radially extending flange 43 on its lower end. Flange 43 has an outer portion that bears against rim 35 as shown in FIG. 5.

Figure 4:
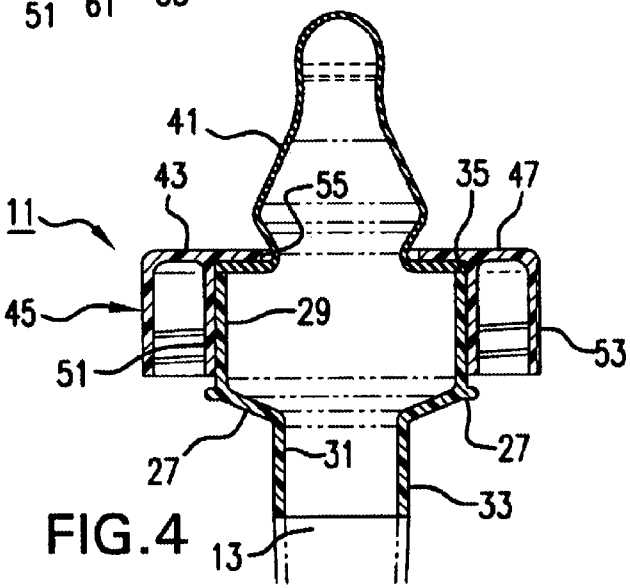
FIG. 4 is a sectional view of the dispenser as shown in FIG. 3, with the nipple and retainer ring attached.

A retainer 45 is placed over nipple 41 into engagement with nipple base 27 as shown FIGS. 4 and 5. Retainer 45 is a ring that has an upper wall 47 that is perpendicular to the longitudinal axis of dispenser 11. Upper wall 47 has a central portion that bears down on nipple flange 43 to form a seal with flange 43. A cylindrical inner or retention wall 51 depends downward from upper wall 47, inward from the outer diameter of upper wall 47. An outer or housing wall 53 depends downward from the periphery of upper wall 47, concentric with inner wall 51 and with the longitudinal axis of dispenser 11. A central aperture 55 is located in upper wall 47. Nipple 41 protrudes through aperture 55.

Retainer 45 preferably snaps onto nipple base 27. In the preferred embodiment, this is handled by a plurality of ribs 57, shown also in FIG. 3, that extend circumferentially in a plane perpendicular to the axis of dispenser 11. Ribs 57 protrude from the interior of inner wall 51 and engage a circumferential groove 59. Groove 59 is formed on the exterior of nipple base wall 29. Ribs 57 are preferably triangular or sawtooth in shape, as well as groove 59. This allows retainer 45 to be readily pressed over nipple base 27, with ribs 57 snapping into engagement with groove 59. Once in engagement, retainer 45 is not removable from base 27. Although shown with ribs 59 on retainer 45, and groove 59 on the exterior of nipple base wall 2:9, the positions of ribs 57 and groove 59 could be reversed. Ribs 57 could be on base wall 29 and groove 59 on inner wall 57.

A set of internal threads 61 are located on the interior side of retainer outer wall 53. Splines 62 are located on the exterior of outer wall 53 to aid in gripping. An annular space exists between inner wall 51 and outer wall 53.

A holder or housing 63 is adapted to enclose bag 13 and engage retainer 45. Housing 63 is a cylindrical, substantially rigid member having an open bottom 65. External threads 67 are located on the upper end of the housing 63. The upper end inserts into the annular space between walls 51, 53, and threads 67 engage threads 61 to secure housing 63 to retainer 45.

In operation, dispenser 11 will be preferably filled at a manufacturing facility and sold with outer compartment 15 containing powder and compartment 17 containing liquid. The powder may be an infant formula, and the liquid may be purified water. Seam 19 will seal the contents of the compartments 15, 17 from each other, and sealing disk 37 will seal the contents of powder compartment 15. The package sold also preferably contains a nipple 41 and a retainer 45,shown in FIG. 3, which are packaged disassembled from dispenser 11. Housing 63 is preferably sold separately and reused.

When it is desired to dispense the beverage, the user will manually squeeze liquid compartment 17 with sufficient force to cause seam 19 to break or rupture. The amount of force required to break seam 19 is far less than that required to rupture seam 25, thus seam 25 will not normally rupture due to squeezing liquid compartment 17. Once broken, the contents of compartment 15, 17 are free to commingle. The user then will flex bag 13 to cause good mixing of the components. The user pulls off sealing disk 37 with pull tab 39. The user than assembles nipple 41 and retainer 45 as shown in FIG. 4. To do this, the user inserts nipple 41 through aperture 55 and presses retainer 45 downward against nipple base 27. Ribs 57 will snap into groove 59, securely locking retainer 45 and sealing with nipple flange 43. The user then may insert housing 63 over bag 13 and secure it with threads 67 to retainer 45. After use, the user unscrews housing 63 from retainer 45. The user discards dispenser 11, along with nipple 41 and retainer 45, while retaining housing 63 for later use.

The invention has significant advantages. The liquid and powder components are maintained in separate compartments. They are readily mixed simply by squeezing the liquid compartment, causing the seam to rupture.

While the invention has been shown in only one of its forms, it should be apparent to those skilled in the art that it is not so limited but is susceptible to various changes without departing from the scope of invention.

I claim:

1. A beverage dispenser, comprising:

a flexible bag having an outlet and two compartments, one adapted to contain beverage powder and the other adapted to contain a liquid;

a seam separating the two compartments, the seam being rupturable due to manual squeezing of the compartment containing the liquid, so as to allow the liquid to mix with the powder to create a beverage;

a mouthpiece attached to the outlet for allowing the beverage to be dispensed into a user's mouth;

a seal attached to the outlet for sealing the powder and liquid in the bag prior to mixing, the seal being removable after the seam has ruptured so as to communicate the beverage with the mouthpiece; and wherein the bag has oppositely facing sidewalls that have portions that touch and bond to each other to form the seam; and wherein the outlet comprises:

a base that has a cylindrical wall and on one end a depending cylindrical neck of lesser outer diameter than the wall of the base, the bag having a mouth that is sealed to the neck, and the base having on another end a rim; and wherein the seal comprises:

a sealing disk that is releasably bonded to the rim of the base.

2. The dispenser according to claim 1, wherein the outlet comprises:

a base that has a cylindrical wall and a depending cylindrical neck, the bag having a mouth that is sealed to the neck, the wall of the base having a rim on an end of the base opposite the neck; and wherein the dispenser further comprises:

a retainer that has a central portion surrounding an aperture and a cylindrical wall depending from the central portion, the wall of the retainer extending over and being releasably secured to the wall of the base; and a flange on the mouthpiece that is deformed between the central portion of the retainer and the rim, the mouthpiece protruding through the aperture of the retainer.

3. The dispenser according to claim 1, further comprising:

a circumferential groove formed on the wall of the retainer and a mating circumferential rib formed on the wall of the base, the rib snapping into the groove when the retainer is pushed onto the base with sufficient force.

4. The dispenser according to claim 1, further comprising:

a circumferential groove formed on the wall of the base and a mating circumferential rib formed on the wall of the retainer, the rib snapping into the groove when the retainer is pushed onto the base with sufficient force.

5. The dispenser according to claim 1, wherein the outlet comprises:

a base that has a cylindrical wall and a depending cylindrical neck, the bag having a mouth that is sealed to the neck; and wherein the dispenser further comprises:

a retainer that has a central portion surrounding an aperture through which the mouthpiece protrudes and cylindrical, concentric inner and outer walls depending from the central portion, the inner wall of the retainer extending over and being releasably secured to the wall of the base, the outer wall of the retainer having a set of internal threads; and a generally cylindrical housing that releasably encloses the bag, the housing having an open upper end with threads that mate with the threads on the outer wall of the retainer.

6. An infant beverage dispenser, comprising;

a flexible bag having two compartments, one adapted to contain infant beverage powder and the other adapted to contain a liquid;

a seam separating the two compartments, the seam being rupturable due to manual squeezing of the compartment containing the liquid, so as to allow the liquid to mix with the powder to create a beverage;

a base having a cylindrical wall having a rim on an upper end and a depending neck on a lower end, the bag having a mouth that is sealed to the neck;

a retainer having a cylindrical retention wall depending from a central portion that has a central aperture, the retention wall extending over and releasably securing the retainer to the base;

a nipple that protrudes through the central aperture and has a radially extending flange that is deformed between the central portion of the retainer and the rim to seal the nipple to the retainer; and a housing having an upper end that releasably secures to the wall of the base and encloses the bag.

7. The dispenser according to claim 6, further comprising:

a sealing disk that removably adheres to the rim to seal the contents of the bag, the sealing disk being removable prior to deforming the flange of the nipple between the rim of the base and the central portion of the retainer.

8. The dispenser according to claims 6, further comprising:

a housing wall depending from the central portion of the retainer, the housing wall surrounding and being radially spaced from the retention wall, the housing wall having internal threads formed therein; and the upper end of the housing having external threads that releasably secure to the internal threads.

9. The dispenser according to claim 6, further comprising:

a circumferential groove formed on one of the walls and a mating circumferential rib formed on the other of the wall, the rib snapping into the groove when the retainer is pushed onto the base with sufficient force.

10. The dispenser according to claim 6, wherein the bag has oppositely facing sidewalls that touch and bond to each other to form the seam.

11. A method of storing and dispensing a beverage, comprising:

(a) providing a flexible bag with an outlet and two compartments separated and sealed from each other by a seam and providing a removable sealing disk over the outlet;

(b) placing a beverage powder in one of the compartments and a liquid in the other compartment and closing the outlet;

(c) when it is desired to dispense the beverage, rupturing the seam by squeezing the compartment containing the liquid, then mixing the liquid with the powder to create a beverage; and (d) opening the outlet and dispensing the beverage from the outlet.

12. The method according to claim 11, wherein step (d) comprises:

removing the sealing disk and securing a nipple to the outlet.

* * * * *